US010344610B2

(12) United States Patent
Loiseau et al.

(10) Patent No.: US 10,344,610 B2
(45) Date of Patent: Jul. 9, 2019

(54) TURBOMACHINE MODULE

(71) Applicant: SAFRAN AIRCRAFT ENGINES, Paris (FR)

(72) Inventors: Cyril Loiseau, Moissy-Cramayel (FR); Alain Dominique Gendraud, Moissy-Cramayel (FR); Sebastien Jean Laurent Prestel, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 250 days.

(21) Appl. No.: 15/501,161

(22) PCT Filed: Aug. 4, 2015

(86) PCT No.: PCT/FR2015/052151

§ 371 (c)(1),
(2) Date: Feb. 1, 2017

(87) PCT Pub. No.: WO2016/024060

PCT Pub. Date: Feb. 18, 2016

(65) Prior Publication Data

US 2017/0218785 A1 Aug. 3, 2017

(30) Foreign Application Priority Data

Aug. 14, 2014 (FR) ..... 14 57829

(51) Int. Cl.
*F01D 11/00* (2006.01)
*F01D 25/24* (2006.01)

(52) U.S. Cl.
CPC ..... *F01D 11/005* (2013.01); *F01D 25/246* (2013.01); *F05D 2240/11* (2013.01)

(58) Field of Classification Search
CPC ..... F01D 11/00; F01D 11/005; F01D 25/24; F01D 25/246

(Continued)

(56) References Cited

U.S. PATENT DOCUMENTS 5,018,943 A * 5/1991 Corsmeier ..... F01D 5/027 416/144
6,076,835 A * 6/2000 Ress ..... F01D 11/005 277/637

(Continued)

FOREIGN PATENT DOCUMENTS

EP 2508715 A2 10/2012
EP 2535522 A2 12/2012

(Continued)

OTHER PUBLICATIONS

International Search Report with English Language Translation, dated Oct. 29, 2015, PCT Application No. PCT/FR2015/052151.

*Primary Examiner* — John Kwon
*Assistant Examiner* — Johnny H Hoang
(74) *Attorney, Agent, or Firm* — Womble Bond Dickinson (US) LLP

(57) ABSTRACT

A turbomachine module, comprising a mobile wheel rotatably mounted inside a housing of the module and surrounded by a sectorised sealing ring (18) that comprises an annular row of sectors, each ring sector comprising at least one circumferential hook that is configured to engage with an annular hooking rail of the housing, the module further comprising a sectorised protective annular shim (50) that is interposed between the hooks of the ring sectors and the rail of the housing and that comprises an annular row of sectors of shim, characterised in that the edges (60) of the circumferential ends of the sectors of shim are not aligned with the edges (58) of the circumferential ends of the ring sectors along the longitudinal axis of the module.

11 Claims, 4 Drawing Sheets

(58) Field of Classification Search
USPC ..... 415/170.1, 173.1–173.3, 174.2, 214.1
See application file for complete search history.

(56) References Cited

U.S. PATENT DOCUMENTS

| | | | | |
|---|---|---|---|---|
| 9,828,865 | B2 * | 11/2017 | Aiello | F01D 5/3038 |
| 9,890,652 | B2 * | 2/2018 | Judet | F01D 5/082 |
| 2006/0083607 | A1 | 4/2006 | Synnott et al. | |
| 2012/0257964 | A1 * | 10/2012 | Littler | F01D 9/04 415/183 |
| 2013/0177400 | A1 * | 7/2013 | Ring | F01D 9/042 415/119 |

FOREIGN PATENT DOCUMENTS

| | | | |
|---|---|---|---|
| EP | 2612998 | A2 | 7/2013 |
| EP | 2613011 | A1 | 7/2013 |
| FR | 2961849 | A1 | 12/2011 |
| WO | WO-9853228 | A1 | 11/1998 |

* cited by examiner

TURBOMACHINE MODULE

TECHNICAL FIELD

The present invention relates to a turbine engine module, which may be a turbine or form part of a turbine for example.

PRIOR ART

The prior art comprises in particular the documents WO-A1-98/53228, EP-A2-2 612 998 and EP-A2-2 508 715.

A turbine engine turbine comprises one or more stages, each comprising a nozzle formed by an annular row of fixed blades carried by a casing of the turbine, and an impeller rotatably mounted in general downstream of the nozzle. The impeller is surrounded by a sealing ring that is sectorised and formed by sectors that are arranged circumferentially end to end and are attached to the turbine casing.

Each ring sector in general comprises a circumferentially oriented metal plate that carries a block of abradable material fixed to the inner surface of the plate. This block is for example of the honeycomb type and is intended to wear by friction on external annular wipers of the blades of the impeller, in order to form a labyrinth seal and to minimise the radial clearances between the impeller and the ring sectors.

Each ring sector comprises, at its upstream and downstream ends, means for attaching to the casing. Each ring sector may comprise, at its upstream end, a circumferential hook that defines an annular groove in which there both an annular rail of the casing and a downstream circumferential hook of the nozzle, located upstream, are engaged. The downstream circumferential hook of the nozzle is kept radially clamped against the casing rail by means of the upstream circumferential hook of the ring, which comprises two coaxial annular walls which extend one inside the other and inside the hook of the nozzle and outside the casing rail, respectively. This makes it possible to participate in the radial holding of the nozzle relative to the casing. The nozzle can be held circumferentially or tangentially by means of an anti-rotation pin that is carried by the casing and is engaged in a recess in the nozzle. Said nozzle is generally axially held in the downstream direction by an annular split ring that is mounted in an annular groove in the aforementioned casing rail which emerges radially towards the outside. The downstream circumferential hook of the nozzle is in axial abutment in the downstream direction on this ring, which is held radially in the groove in the casing rail by the internal walls of the hooks of the ring sectors which extend radially inside the ring. In a variant, the axial stop function of this ring may be provided directly by the casing rail.

It is known to use an annular foil for protecting the casing rail, in particular against wear and high temperatures. This foil is sectorised and comprises an annular row of foil sectors arranged circumferentially end to end. Said foil has a generally U-shaped or C-shaped cross section and comprises two coaxial annular walls, inner and outer, respectively, that are interconnected by a middle bottom wall.

The opening of the hooks of the ring sectors is oriented axially upstream and receives the foil sectors, which are designed so that their walls line those of the hooks of the ring sectors. The inner walls of the foil sectors are intended to extend over the radially outer faces of the inner walls of the hooks of the ring sectors, the outer walls of the foil sectors are intended to extend over the radially inner faces of the outer walls of the hooks of the ring sectors, and the bottom walls of the foil sectors are intended to extend over the upstream radial faces of the bottom walls of the hooks of the ring sectors.

In the position of mounting the ring sectors on the casing rail, the inner walls of the foil sectors are interposed between the inner walls of the hooks of the ring sectors and the hooks of the nozzle, or even the annular ring, the outer walls of the foil sectors are interposed between the outer walls of the hooks of the ring sectors and the casing rail, and the bottom walls of the foil sectors are interposed between the bottom walls of the hooks of the ring sectors and the casing rail.

The foil sectors are made from sheet metal and make it possible to prevent any direct contact between the hooks of the ring sectors and the casing rail, which makes it possible both to protect said rail against wear by friction and to protect it thermally from the ring, which may be very hot in operation because of its proximity to the combustion gases flowing in the turbine duct.

Because of the sectorisation of the ring, the longitudinal edges of the circumferential ends of two adjacent sectors of the ring face one another and are separated from one another by a circumferential clearance through which the hot gases of the duct can pass. These hot gases have a tendency to heat the casing, which is detrimental for several reasons. One of the reasons is that heating of the casing would cause expansion and deformation thereof, which would risk altering the radial clearances between the movable impeller and the ring, and therefore reducing the performance of the turbine. A known solution to this problem consists in interposing sealing tongues between the ring sectors, which tongues are housed in grooves in the aforementioned longitudinal edges of said ring sectors.

However, because of the sectorisation of the foil, the longitudinal edges of the circumferential ends of two adjacent foil sectors face one another and are separated from one another by a circumferential clearance. In the prior art, the circumferential clearances between the foil sectors are aligned axially with the circumferential clearances between the ring sectors, and in particular with the circumferential clearances between the hooks of the ring sectors in the region of which it is not possible to mount tongues of the aforementioned type, in particular for reasons of space requirement. Hot gases can thus pass through the circumferential clearances between the hooks of the ring sectors and between the foil sectors and heat the casing rail, which risks reducing its service life.

The object of the present invention is in particular to provide a simple, effective and economical solution to this requirement by improving, in particular, the thermal protection of the casing rail in the aforementioned case.

DISCLOSURE OF THE INVENTION

The present invention thus proposes a turbine engine module comprising a movable impeller that is rotatably mounted inside a casing of the module and is surrounded by a sectorised sealing ring that comprises an annular row of ring sectors arranged such that circumferential end edges of two adjacent sectors substantially face one another, each ring sector comprising at least one circumferential hook that is designed to cooperate with an annular attachment rail of the casing, the module further comprising an annular sectorised protective foil that is interposed between the hooks of the ring sectors and the casing rail and comprises an annular row of foil sectors arranged such that circumferential end edges of two adjacent sectors substantially face one another, characterised in that the number of ring sectors is equal to the number of foil sectors, and in that the foil sectors comprise positioning means and/or rotational locking means designed so that the edges of the circumferential ends of the foil sectors are not aligned with the edges of the circumferential ends of the ring sectors along the longitudinal axis of the module.

The invention makes it possible to better protect the casing rail, since the gases that would be liable to pass between the edges of the circumferential ends of the ring sectors would then be blocked by the foil sectors (because of the angular offset thereof relative to the ring sectors) and would not reach as far as the casing rail.

The module according to the invention may comprise one or more of the following features, taken in isolation or in combination with one another:

- the number of ring sectors is equal to the number of foil sectors;
- the ring sectors are arranged so as to be staggered with respect to the foil sectors;
- the hooks of the ring sectors have a generally U-shaped or C-shaped cross section, the opening of which is oriented axially, and each comprise a middle bottom wall that connects two coaxial annular walls that are radially inner and outer, respectively;
- the foil sectors have a generally U-shaped or C-shaped cross section, the opening of which is oriented axially, and each comprise a middle bottom wall that connects two coaxial annular walls, radially inner and outer, respectively, the foil sectors being engaged in the openings of the hooks of the ring sectors and mounted on the casing rail so that the inner walls of the foil sectors are interposed between an inner face of the casing rail and the outer walls of the hooks of the ring sectors, so that the bottom walls of the foil sectors are interposed between a substantially radial face of the casing rail and the bottom walls of the hooks of the ring sectors, and so that the outer walls of the foil sectors are interposed between an outer face of the casing rail and the outer walls of the hooks of the ring sectors;
- the inner walls of the hooks of the ring sectors have a radius of curvature different from that of the casing rail so as to be mounted in a radially pre-stressed manner on the rail,
- the inner walls of the foil sectors comprise radial recesses that emerge on free circumferential edges of the foil sectors and are substantially aligned axially with the edges of the circumferential ends of the hooks of the ring sectors; these recesses form positioning means within the meaning of the invention;
- said recesses are each generally V-shaped and are substantially formed at the centre of the inner walls of the foil sectors;
- the circumferential ends of the inner walls of the hooks of the ring sectors are in radial abutment on the inner walls of the foil sectors, substantially in line with the bottoms of the recesses;
- the inner or outer walls of the hooks of the ring sectors comprise radial recesses substantially at the centre thereof, and the inner or outer walls of the foil sectors comprise either radial end recesses that are substantially aligned radially with the aforementioned recesses of the hooks of the ring sectors, or foldable radial lugs that are designed so as to be folded and engaged in the aforementioned recesses of the hooks of the ring sectors; these recesses and/or lugs form means for rotational locking (about the longitudinal axis of the module) within the meaning of the invention; and
- the module is a turbine.

The present invention also relates to a turbine engine, comprising at least one module as described above.

Finally, the present invention relates to a sectorised annular protective foil for a module as described above, comprising an annular row of foil sectors, in which each foil sector has a generally U-shaped or C-shaped cross section, the opening of which is oriented axially, and comprises a middle bottom wall that connects two coaxial annular walls, radially inner and outer, respectively, said inner walls comprising radial recesses substantially at the centre thereof which emerge on free circumferential edges of the sectors.

DESCRIPTION OF THE FIGURES

The invention will be understood better and other details, features and advantages of the invention will emerge from reading the following description given by way of non-limitative example and with reference to the accompanying drawings, in which.

DETAILED DESCRIPTION

Figure 1:
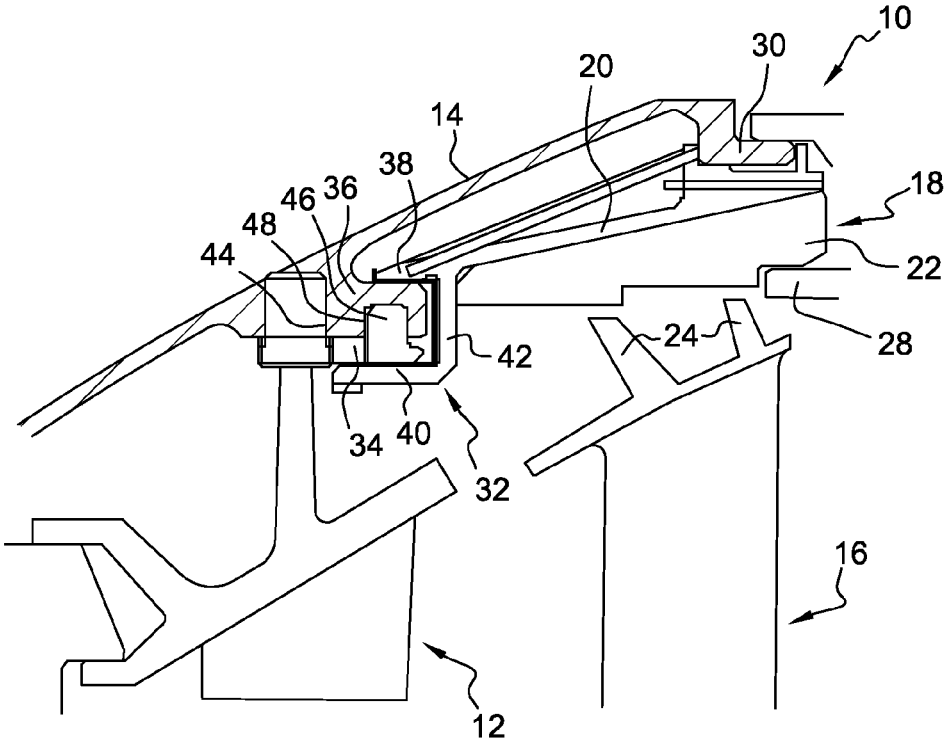
FIG. 1 is a schematic partial half-view in axial section of a turbine engine turbine.
Figure 2:
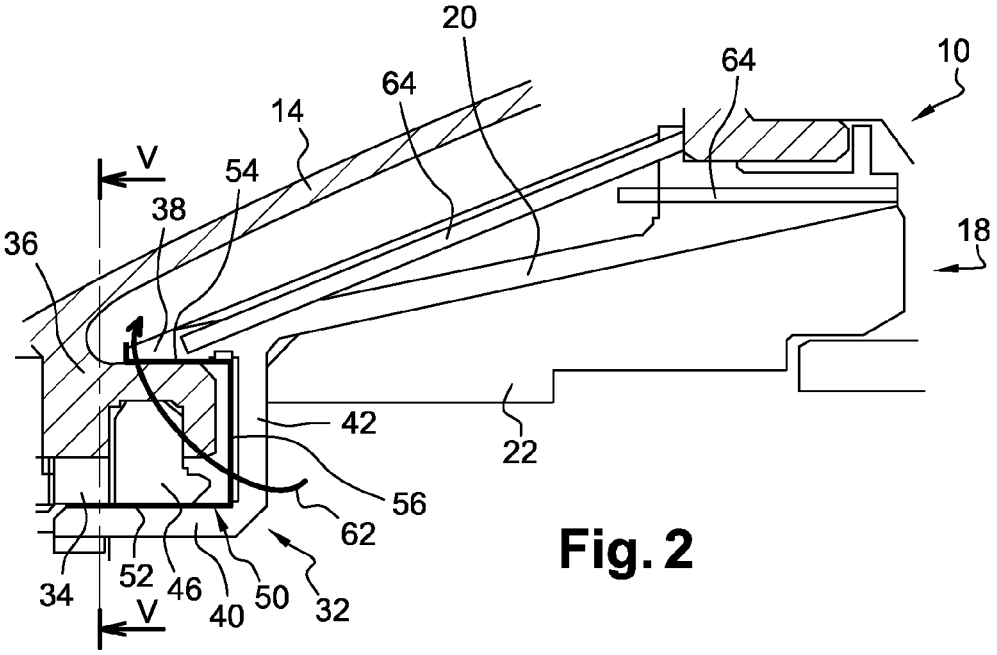
FIG. 2 is a larger-scale schematic view of part of FIG. 1 and shows a sealing ring and an annular foil of the turbine.

Reference is made first of all to FIGS. 1 and 2, which show a turbine 10, in this case low pressure, of a turbine engine such as an aeroplane turbojet engine or turboprop engine, said turbine comprising a plurality of stages (only one of which is shown here) each comprising a nozzle 12 formed by an annular row of fixed blades carried by a casing 14 of the turbine, and an impeller 16 mounted downstream of the nozzle 12 and rotating in a ring 18 attached to the casing 14.

The ring 18 is sectorised and formed by a plurality of sectors that are carried circumferentially end to end by the casing 14 of the turbine.

Each ring sector 18 comprises a frustoconical wall 20 and a block 22 of abradable material that is fixed by brazing and/or welding to the radially inner surface of the wall 20, this block 22 being of the honeycomb type and being intended to wear by friction on outer annular wipers 24 of the blades of the impeller 16 in order to minimise the radial clearances between the impeller and the ring sectors 18.

Each ring sector 18 comprises, at its upstream end, a circumferential hook 32 having a C-shaped or U-shaped cross section, the opening of which emerges in the upstream direction, and which is engaged, at one end, axially from the downstream direction on a cylindrical hook 34 oriented in the downstream direction of the nozzle 12 located upstream of the ring sectors 18, and, at the other end on a cylindrical rail 36 of the casing 14 to which said nozzle is attached.

The hook 32 of each ring sector 18 comprises two circumferential walls 38 and 40, radially outer and radially inner, respectively, that extend in the upstream direction, are interconnected at their upstream ends by a substantially radial middle bottom wall 42, and extend radially to the outside and to the inside, respectively, of the rail 36, the inner wall 40 holding the hook 34 of the nozzle radially against the rail 36.

The nozzle 12 is held circumferentially by means of an anti-rotation pin 44 that is carried by the casing 14 and is engaged in a recess in the nozzle 12. Said nozzle is held axially in the downstream direction by an annular split ring 46 that is mounted in an annular groove 48 in the rail 36 which emerges radially towards the inside. The hook 34 of the nozzle 12 is in axial abutment in the downstream direction on the ring 46, which is held radially in the groove in the casing rail by the inner wall 40 which extends radially inside the ring 46. In a variant, the axial stop function of the ring 46 can be provided directly by the casing rail 36.

The downstream ends of the ring sectors 18 are clamped radially on a cylindrical rail 30 of the casing by the nozzle located downstream of the ring sectors. The ring sectors 18 are in radial abutment towards the outside on a radially inner cylindrical face of the rail 30 of the casing, and towards the inside on a radially outer cylindrical face of a cylindrical rim 28 of the downstream nozzle.

In order to protect the rail 36 thermally and against wear, it is known to use an annular foil 50 that is sectorised and comprises an annular row of foil sectors arranged circumferentially end to end. Said foil has a generally C-shaped or U-shaped cross section and comprises two coaxial annular walls, inner 52 and outer 54, respectively, that are interconnected by a middle bottom wall 56.

The foil 50 is mounted on the casing rail 36 and on the hook 34 of the nozzle 12 so that the inner walls 52 of the foil sectors 50 are interposed between the inner walls 40 of the hooks 32 of the ring sectors 18 and the hooks 34 of the nozzle 12 and the annular ring 46, so that the outer walls 54 of the foil sectors are interposed between the outer walls 38 of the hooks 32 of the ring sectors and the casing rail 36, and so that the bottom walls 56 of the foil sectors are interposed between the bottom walls 42 of the hooks of the ring sectors and the casing rail 36 (FIG. 2).

The foil sectors 50 are made from sheet metal and make it possible to prevent any direct contact between the hooks 32 of the ring sectors 18 and the casing rail 36, which makes it possible both to protect said rail against wear by friction and to protect it thermally from the ring, which may be very hot in operation because of its proximity to the combustion gases flowing in the turbine duct.

Figure 3:
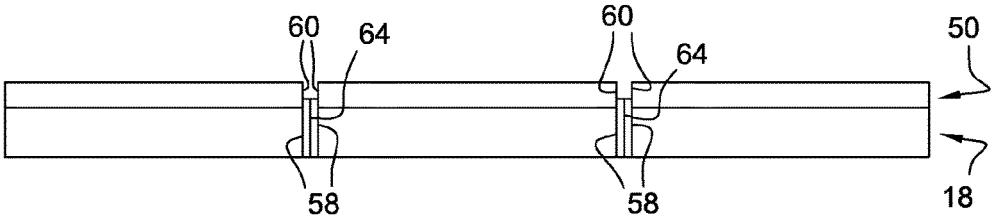
FIG. 3 is a schematic partial plan view of the sealing ring and of the annular foil of a turbine according to the prior art.

As explained above and illustrated by FIG. 3, which shows the prior art for the present invention, the longitudinal edges 58 of the circumferential ends of the ring sectors 18 are separated from one another by circumferential clearances through which hot gases of the turbine duct can pass. The longitudinal edges 60 of the circumferential ends of the foil sectors 50 are also separated from one another by circumferential clearances that are aligned axially with the clearances between the ring sectors 18. The aforementioned hot gases can pass through the circumferential clearances between the hooks 32 of the ring sectors 18 and between the foil sectors 50 and heat the casing rail 36 (arrow 62 in FIG. 2) which risks reducing its service life. This is because the tongues 64 that are mounted between the longitudinal edges 58 of the circumferential ends of the ring sectors 18 do not extend as far as the hooks 32 of the ring sectors 18 and do not prevent the passage of gas in this region.

Figure 4:
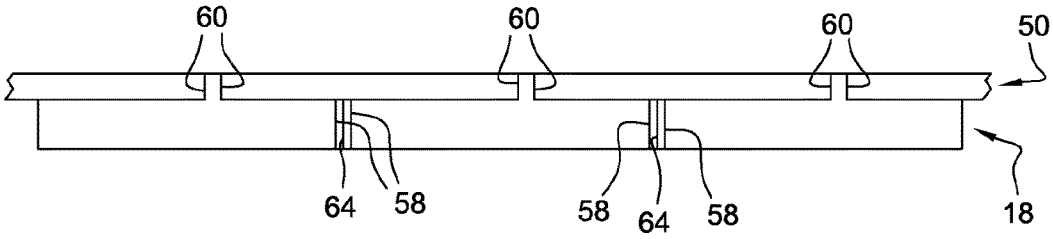
FIG. 4 is a schematic partial plan view of the sealing ring and of the annular foil of a turbine according to the invention.

The invention makes it possible to overcome this problem by virtue of the angular offset of the longitudinal edges 60 of the circumferential ends of the foil sectors 50 relative to the longitudinal edges 58 of the circumferential ends of the ring sectors 18. FIG. 4 shows an embodiment of the invention in which the foil sectors 50 are arranged so as to be staggered relative to the ring sectors 18. The gases that are liable to pass through the circumferential clearances between the hooks 32 of the ring sectors 18 are then blocked by the foil sectors 50 and do not get as far as the casing rail 36, which has a better service life.

Figure 5:
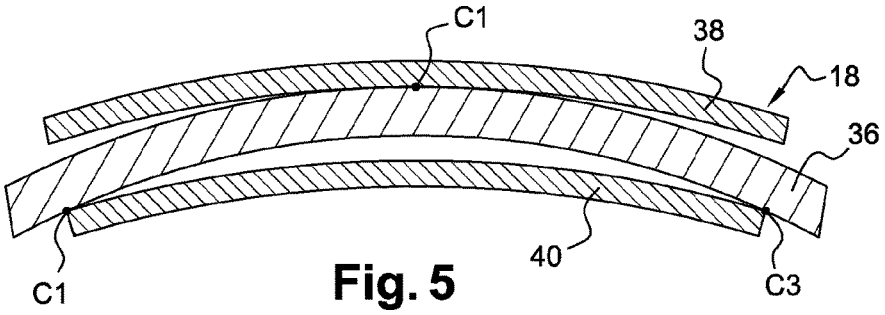
FIG. 5 is a schematic view in cross section along the line V-V in FIG. 2.

As can be seen in FIG. 5, the walls 38, 40 of the ring sectors 18 are "pre-cambered" with respect to the casing rail 36, that is to say they have radii of curvature greater that are than that of the casing rail 36, which makes it possible to mount them on the rail so as to be pre-stressed to some degree. Because of this pre-cambering, the ring sector 18 shown in FIG. 5 has bearing zones C1, C2, C3 on the rail 36 that are not very extensive. The middle part of the inner face of the wall 38 of the sector 18 is in abutment at C1 on the outer face of the rail 36 (by means of the walls 54 of the foil sectors 50, when used) and the end parts of the outer face of the wall 40 are in abutment at C1 and C3 on the inner face of the rail 36 or on the hook 34 of the nozzle 12 and the ring 46, as in the example shown (by means of the walls 52 of the foil sectors 50, when used).

Figure 6:
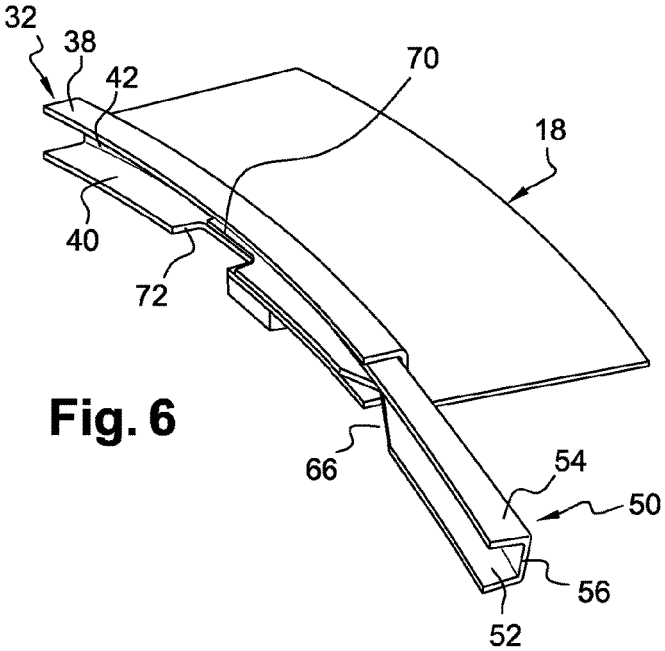
FIGS. 6 and 7 are schematic perspective views of a ring sector and of a foil sector, according to an embodiment of the invention.
Figure 7:
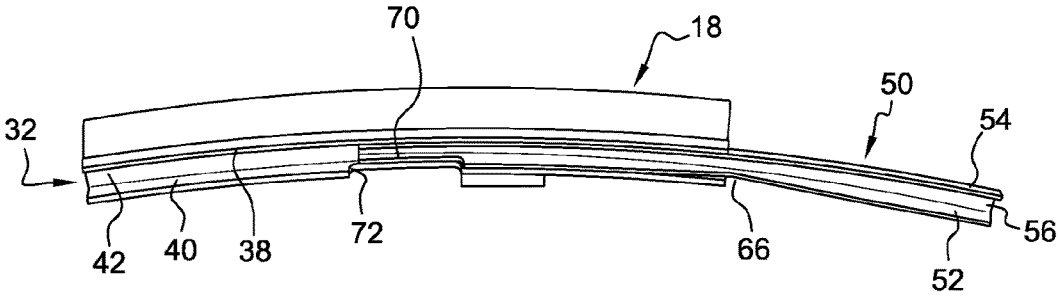
Figure 8:
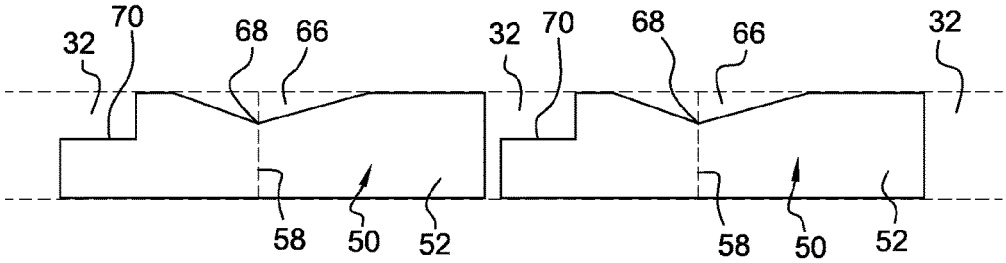
FIG. 8 is a highly schematic partial view from below of the foil of FIGS. 6 and 7.

In order not to place excessive stress on the foil sectors 50, by pinching between the circumferential ends of the ring sectors 18 and the casing rail 36, the embodiment shown in FIGS. 6 to 8 proposes a particular shaping of the foil sectors and especially of the inner walls 52 thereof. In the absence of such shaping, the risk would be that of prematurely wearing the foil sectors 50 and creating crack initiation zones in the bearing zones C1, C3.

In the example shown, the inner wall 52 of each foil sector 50 comprises a recess 66 substantially at the centre thereof. This recess 66 emerges on the free circumferential edge upstream of the wall 52 and is generally V-shaped here. Each recess 66 has a circumferential extent of between 30 and 60% of the circumferential extent of the foil sector 50 and a longitudinal dimension of between 10 and 50% of the longitudinal dimension of the foil sector 50.

As can be seen in FIG. 8, in which foil sectors 50 are shown in continuous lines and ring sectors 18 are shown in broken lines, the longitudinal edges 58 of the circumferential ends of the hooks 32 of the ring sectors 18 are located substantially in line with the bottoms 68 of the recesses 66. These recesses 66 provide the inner walls 52 of the foil sectors 50 with some degree of flexibility.

According to the invention, the foil sectors 50 may also be equipped with rotational locking means.

In the example shown in FIGS. 6 to 8, these locking means comprise a recess 70 formed at a circumferential end of the inner wall 52 of each foil sector 50. This recess 70 emerges on the free circumferential edge upstream of the wall 52 as well on the longitudinal edge of the corresponding end of the wall. It has a roughly rectangular shape here. Each recess 70 has a circumferential extent of between 10 and 30% of the circumferential extent of the foil sector 50 and a longitudinal dimension of between 20 and 70% of the longitudinal dimension of the foil sector 50.

In the mounting position, the recess 70 of each foil sector 50 is aligned radially with a recess 72 in the inner wall 40 of the hook of the ring sector 18, which is located substantially at the centre of this wall. The recesses 70, 72 are intended to receive a detent (not shown) of the nozzle 12 in order to immobilise the ring sector 18 and the foil sector in rotation with respect to one another as well as with respect to the casing 14.

Figure 9:
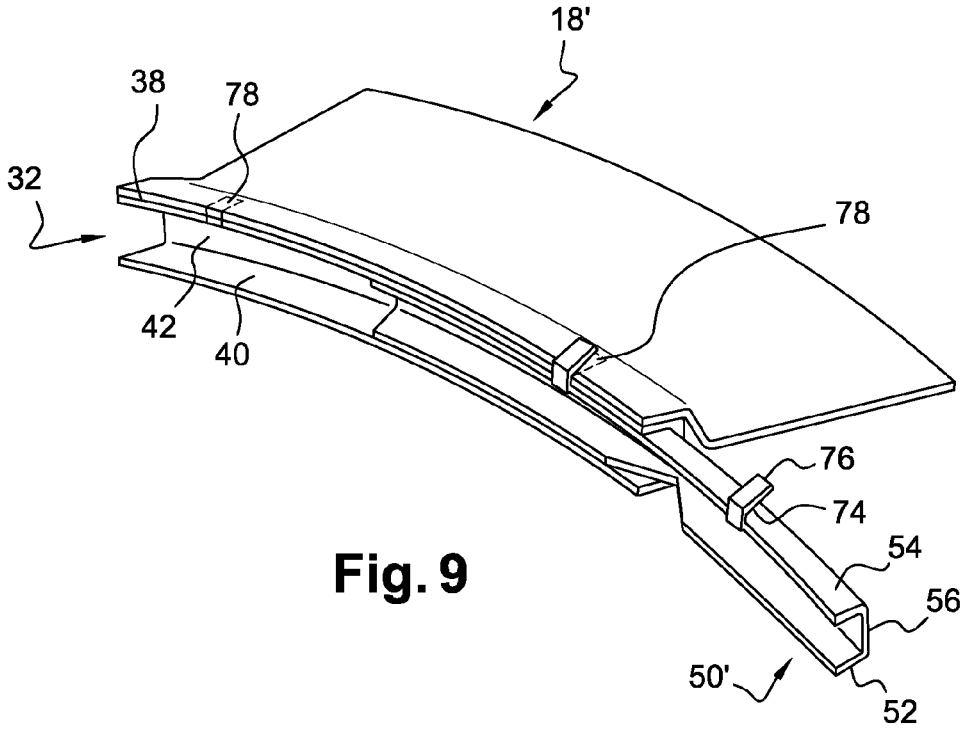
FIGS. 9 and 10 are schematic views, in perspective and in axial section, respectively, of a variant of a ring sector and of a foil sector.
Figure 10:
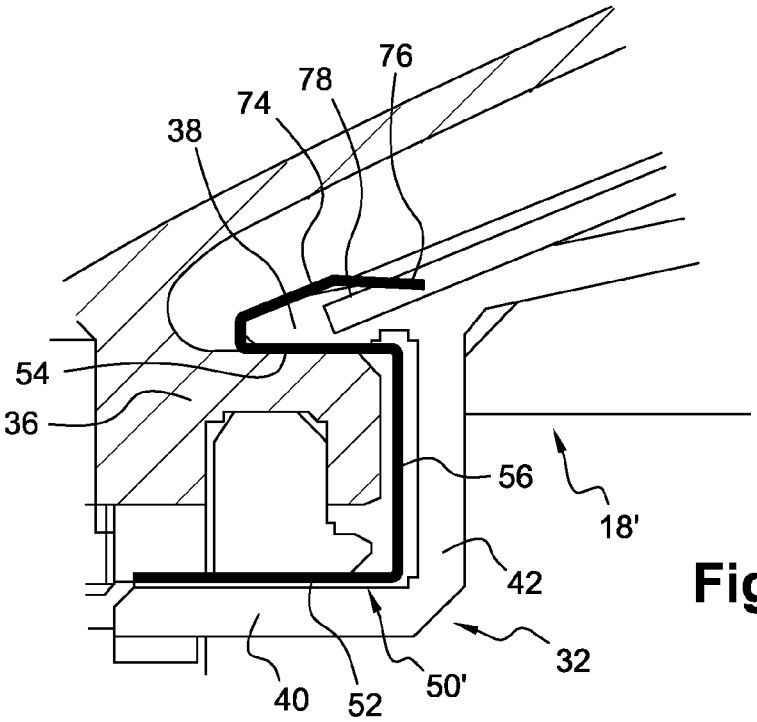

FIGS. 9 and 10 show a variant of the locking means that, here, comprise a foldable lug 74. In this case, a lug 74 is carried by the outer wall 54 of each foil sector 50'. Said lug is located substantially at the centre of the sector 50' and extends, at rest, radially outwards and downstream. Its outer radial end 76 is intended to be deformed and folded radially inwards so as to engage in an outer radial recess 78 in the outer wall 38 of the hook of the ring sector 18'. This immobilises the foil sector 50' in rotation with respect to the ring sector 18'. In a variant, each foil sector may comprise more than one anti-rotation lug of this type.

The invention claimed is:

1. A turbine engine module comprising a movable impeller that is rotatably mounted inside a casing of the module and is surrounded by a sectorised sealing ring that comprises an annular row of ring sectors arranged such that circumferential end edges of two adjacent sectors substantially face one another, each ring sector comprising at least one circumferential hook to cooperate with an annular attachment rail of the casing, the module further comprising an annular sectorised protective foil that is interposed between the hooks of the ring sectors and the casing rail and comprises an annular row of foil sectors arranged such that circumferential end edges of two adjacent sectors substantially face one another, wherein the number of ring sectors is equal to the number of foil sectors, and in that the foil sectors comprise positioning means or rotational locking means for preventing the edges of the circumferential ends of the foil sectors from aligning with the edges of the circumferential ends of the ring sectors along the longitudinal axis of the module.

2. The module according to claim 1, wherein the ring sectors are arranged so as to be staggered with respect to the foil sectors.

3. The module according to claim 1, wherein the hooks of the ring sectors have a generally U-shaped or C-shaped cross section, the opening of which is oriented axially, and each comprise a middle bottom wall that connects two coaxial annular walls, radially inner and outer, respectively, and wherein the foil sectors have a generally U-shaped or C-shaped cross section, the opening of which is oriented axially, and each comprise a middle bottom wall that connects two coaxial annular walls, radially inner and outer, respectively, the foil sectors being engaged in the openings of the hooks of the ring sectors and mounted on the casing rail such that the inner walls of the foil sectors are interposed between an inner face of the casing rail and the inner walls of the hooks of the ring sectors, such that the bottom walls of the foil sectors are interposed between a substantially radial face of the casing rail and the bottom walls of the hooks of the ring sectors, and such that the outer walls of the foil sectors are interposed between an outer face of the casing rail and the outer walls of the hooks of the ring sectors.

4. The module according to claim 3, wherein the inner walls of the hooks of the ring sectors have a radius of curvature that is different from that of the casing rail so as to be mounted in a radially pre-stressed manner on the rail.

5. The module according to claim 4, wherein the inner walls of the foil sectors comprise radial recesses that emerge on free circumferential edges of the foil sectors and are substantially aligned axially with the edges of the circumferential ends of the hooks of the ring sectors.

6. The module according to claim 5, wherein said recesses are each generally V-shaped and are substantially formed at the centre of the inner walls of the foil sectors.

7. The module according to claim 5, wherein the circumferential ends of the inner walls of the hooks of the ring sectors are in radial abutment on the inner walls of the foil sectors, substantially in line with the bottoms of the recesses.

8. The module according to claim 4, wherein the inner or outer walls of the hooks of the ring sectors comprise radial recesses substantially at the centre thereof, and wherein the inner or outer walls of the foil sectors comprise either radial end recesses that are substantially aligned radially with the aforementioned recesses of the hooks of the ring sectors, or foldable radial lugs that are designed so as to be folded and engaged in the aforementioned recesses of the hooks of the ring sectors.

9. A turbine engine comprising at least one module according to claim 1.

10. An annular sectorised protective foil for a module according to claim 1, comprising an annular row of foil sectors, wherein each foil sector has a generally U-shaped or C-shaped cross section, the opening of which is oriented axially, and comprises a middle bottom wall that connects two coaxial annular walls, radially inner and outer, respectively, said inner walls comprising radial recesses substantially at the centre thereof which emerge on free circumferential edges of the sectors.

11. The module according to claim 1, wherein the number of ring sectors is equal to the number of foil sectors, and in that the foil sectors comprise positioning means and rotational locking means for preventing the edges of the circumferential ends of the foil sectors from aligning with the edges of the circumferential ends of the ring sectors along the longitudinal axis of the module.

* * * * *